United States Patent [19]

Xu-Yi et al.

[11] Patent Number: 4,712,514

[45] Date of Patent: Dec. 15, 1987

[54] FLUIDIZED BED BOILER AND HIGH TEMPERATURE SEPARATORS USED THEREIN

[75] Inventors: Zhang Xu-Yi; Yue Guangxi; Zheng Qiayu, all of Beijing, China

[73] Assignee: Qinghua University, Beijing, China

[21] Appl. No.: 903,935

[22] Filed: Sep. 5, 1986

[51] Int. Cl.[4] ..... F22B 1/00

[52] U.S. Cl. ..... 122/4 D; 110/216; 55/17

[58] Field of Search ..... 122/4 D; 55/17; 110/216, 245

[56] References Cited

U.S. PATENT DOCUMENTS

| | | | |
|---|---|---|---|
| 3,362,131 | 1/1968 | Becker | 55/17 |
| 3,616,596 | 11/1971 | Campargue | 55/17 |
| 3,989,483 | 11/1976 | Becker et al. | 55/17 |
| 4,270,468 | 6/1981 | Robinson et al. | 122/4 D |
| 4,301,771 | 11/1981 | Jukkola et al. | 122/4 D |
| 4,344,782 | 8/1982 | Groszstuck | 55/17 |
| 4,419,965 | 12/1983 | Garcia-Mallol et al. | 122/4 D |
| 4,538,549 | 9/1985 | Stromberg | 122/4 D |
| 4,551,157 | 11/1985 | Becker et al. | 55/17 |

FOREIGN PATENT DOCUMENTS

| | | | |
|---|---|---|---|
| 2754276 | 7/1979 | Fed. Rep. of Germany | 55/17 |
| 2037609 | 7/1980 | United Kingdom | 55/17 |
| 776640 | 11/1980 | U.S.S.R. | 55/17 |

*Primary Examiner*—Henry C. Yuen

*Attorney, Agent, or Firm*—Marvin A. Naigur; Warren B. Kice

[57] ABSTRACT

A fluidized bed boiler and a high temperature separator used therein. Each separator consists of a horizontal S-shaped passage formed in a casted block and having an inlet for receiving flue gases from the boiler. A divider wall divides a portion of the passage into a dense-phase gas bypass and a vertical-flow ash collecting chamber. As a result flyash of a diameter (50 μm) can be separated, and the combustion cycle efficiency can reach over 98%.

6 Claims, 3 Drawing Figures

FLUIDIZED BED BOILER AND HIGH TEMPERATURE SEPARATORS USED THEREIN

BACKGROUND OF THE INVENTION

This invention relates to a fluidized bed boiler and a high temperature separator used in said boiler and, more particularly, to such a boiler and separator in which the separator has a low resistance and achieves a high separation efficiency.

Current state-of-the-art fluidized bed boilers are not equipped with high-temperature separators for separating the fine particulate material from the gases exiting the boiler. Consequently, a large amount of fine, unreacted materials is blown out of the boiler which results in poor utilization of fuel and sulfur removal agent. For boilers burning fuels with high ash content, this can also cause severe abrasion of the downstream heat-transfer surfaces.

High-speed, or circulating, fluidized bed boilers are equipped with high-temperature separators which capture the flyash and reuse it. The separators are generally of cyclone type, and the flow resistance through the separators at high temperatures is as high as 100–150 mm of water column. As a result, the increase of electricity consumption by the draft fan is equivalent to 4% of fuel cost. This type of separator is difficult to scale up and its efficiency decreases as its capacity increases. Additionally, its structure is complicated and its ash and gas discharge locations are rather localized, which have adverse effects on ash recycle, heat transfer, and the arrangement of convective heat-transfer surfaces.

SUMMARY OF THE PRESENT INVENTION

It is therefore an object of the present invention to provide fluidized bed boiler equipped with S-shaped separators having low resistance and high separation efficiency.

It is a further object of the present invention to provide a fluidized bed boiler of the above type with features that include high combustion efficiency, easy-to-build construction, and steady performance when scaling up.

It is a still further object of the present invention to provide a high temperature separator for use in a fluidized bed boiler and having the aforementioned advantages.

Towards the fulfillment of these and other objects, the fluidized bed boiler of the present invention includes one or more separators having S-shaped passages installed at the flue gas exit in the upper section of the fluidized bed furnace. Each separator consists of a horizontal-flow S-shaped passage formed in a casted block. A bypass for the densephase gas, and a vertical-flow ash collecting chamber are formed in the S-shaped passage by a flow dividing wall. The separator's modules and the supporting wall underneath them constitute one or several sidewalls of the furnace.

DESCRIPTION OF THE PREFERRED EMBODIMENTS

Figure 1:
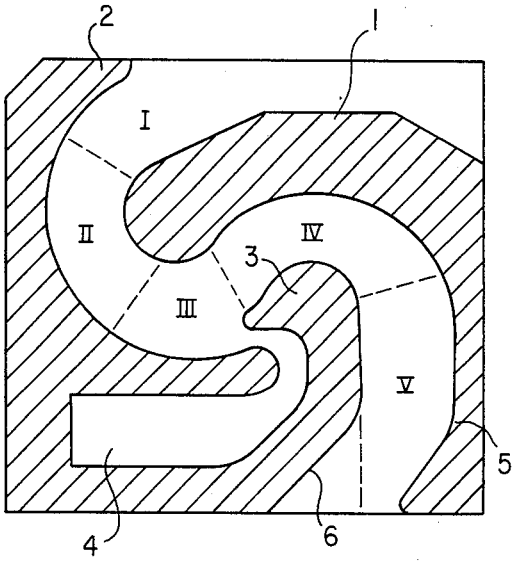
FIG. 1 is a horizontal cross-section view of a single S-shaped separator according to the present invention.
Figure 2:
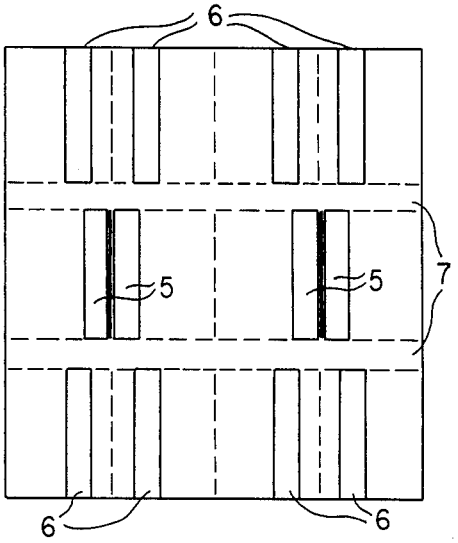
FIG. 2 is a schematic showing the arrangement of exit openings of a separator assembly of the present invention.

As shown in FIG. 1, the S-shaped separator of the present invention is formed by two casted blocks 1 and 2 and a dividing wall 3. A horizontal passage is formed through the separator and consists of five sections: an entrance section I, a concentrical annular section II, an eccentrical annular section III, a turning section IV, and an exit section V. The entrance section I is a long vertical slot along the height of the furnace, and the flat surface of the block 1 at the entrance section makes an angle of 15°–30° with its frontal flat surface. The block 2 has a cylindrical surface and to assure proper flow direction at the entrance, the front edge of the block 2 is located 50–100 mm ahead of the front edge of the block 1. The concentrical annular section II joins smoothly with the entrance section I. The vertical cross-section area of the S-shaped passage is sized to assure a horizontal flow velocity of 20–25 m/s. The flow dividing wall 3 divides the horizontal passage into two portions. The portion that leads the dense gas stream to the ash collecting chamber 4 occupies 10%–20% of the total vertical cross-section area of the S-shaped passage, and preferably 15%. This flow bypass leads to the ash collecting chamber 4 via a smooth transition section. At the exit section of the S-shaped passage, there are two types of exit openings i.e. a straight-flow exit 5 and a tangential-flow exit 6. When multiple separators are assembled together, the exit openings 5 and 6 are alternately arranged on different levels along the height of the furnace in order to reduce the exit gas velocity as quickly as possible. To achieve better flow distribution, the exit openings of two adjacent separators are arranged laterally in a symmetric manner. This is shown in the arrangement of FIG. 2 in which a symmetric layout of four straight-flow exits 5 form a middle row, and a series of four tangential-flow exits 6 form the top and bottom rows.

For a larger capacity boiler, separators can be added either in a vertical direction, a lateral direction, or both. A flat partition wall 7 is installed between any two levels of separators and flow openings are provided through partition walls at the locations corresponding to the respective ash collecting chambers to discharge the dense-phase gas stream.

Figure 3:
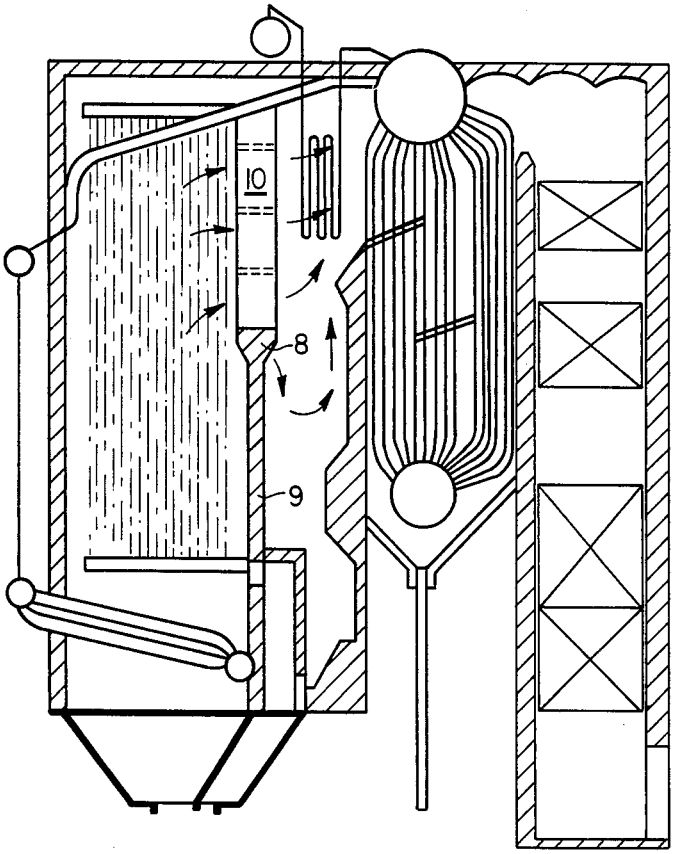
FIG. 3 shows the typical locations of a plurality of the S-shaped separators of the present invention located inside a boiler.

FIG. 3 depicts a pluarlity of the separators of the present invention shown mounted in a sidewall 10 of the furnace section of a boiler, with the sidewall extending coextensive with, and supported by, a support wall 9. A passage 8 is formed through the upper portion of the wall 9 and is connected to the chamber 4 for providing for the discharge of flyash from the latter chamber.

In operation, after entering the separator of the present invention the flue gas with flyash from the furnace is accelerated to 20–25 m/s and rotated 180°–240° in the S-shaped, horizontal passage. A large majority of flyash particles in the gas stream are separated and forced toward the wall by centrifugal action. The flow dividing wall (3) divides the flue gas into two streams. The outer stream, which carries most of flyash, is guided into an ash collecting chamber (4) and from this chamber, exits through the opening 8 (FIG. 3). The inner gas stream, which contains a very small amount of flyash, follows the remaining S-shaped passage and leaves the separator through an exit opening 5 or 6 before passing to and through the heat recovery sections of the boiler shown in the right portion of FIG. 3.

The S-shaped separator of the present invention can be casted from refractory materials. Its structure is simple and is easy to fabricate. Also flyash of a median diameter (approximately 50 microns) can be separated, and the combustion cycle efficiency (bituminous coal with a heating value higher than 4000 Kcal/kg) can reach over 98%. This invention has the further advantages of reducing electric power consumption of the draft fan and maintaining steady performance in scaling up or down. When the separator of the present invention is applied to a industrial boiler of 4–35 ton/hr capacity, the boiler efficiency can be improved by 8–15%, and the coal consumption can be reduced by 10–20%. For boilers having even greater capacity, the utilization rate of the sulfur removal agent can be doubled by use of the separator of the present invention. For fluidized bed boilers burning high ash content coal, the separator of the present invention can reduce the abrasion of the downstream heat-transfer surfaces. When the boiler is connected with a staged precipitator, the first stage precipitator can be eliminated with the addition of separators of the present invention.

What is claimed is:

1. A fluidized bed boiler comprising a furance section, a plurality of separators disposed adjacent said furnace section for receiving flue gases from said furnace section and separating fine particulate material from said gases, each separator comprising a casted block having an curved inlet passage formed therein, a portion of said solid particles being forced against a curved wall portion of said inlet passage by centrifugal forces to separate said solid particles from said gases, said block including partition means for dividing the other end portion of said passage into two branch passages, a wall portion of one of said branch passages being coextensive with said curved wall portion to receive said separated solid particles, the other branch passage adapted to receive the separated gases and discharge said gases from an end thereof extending flush with a second surface of said block, the discharge end of the other branch passage of a portion of said separators extending perpendicular to said second surface and the discharge end of the other branch passage of the remaining portion of said separators extending at an angle to said second surface and said separators are stacked in a vertical direction adjacent said furnace section, with the perpendicularly extending and the angularly extending discharge ends of their respective other branch passages extending in an alternating relationship.

2. The boiler of claim 1 wherein said inlet passage is S-shaped.

3. The boiler of claim 1 wherein one end portion of said inlet passage extends flush with a first surface of said block and is adapted to receive said gases.

4. The boiler of claim 1 wherein each block comprises two block portions each having passage sections formed therein, said block portions being joined together with their respective passage sections defining said inlet passage.

5. The boiler of claim 1 wherein said one branch passage occupies 10–20% of the total vertical cross-sectional area of said inlet passage.

6. The boiler of claim 1 wherein said one end portion of said inlet passage is in the form of a long vertical slot extending along the height of said furnace.

* * * * *